US005196675A

United States Patent [19]

Suzuki et al.

[11] Patent Number: 5,196,675

[45] Date of Patent: Mar. 23, 1993

[54] IMAGE FIXING APPARATUS HAVING A HEATER, A MOVABLE FILM AND ELECTRICAL INSULATING MEMBER DISPOSED AT LATENT END

[75] Inventors: Yoshihiko Suzuki; Koki Kuroda, both of Tokyo, Japan

[73] Assignee: Canon Kabushiki Kaisha, Tokyo, Japan

[21] Appl. No.: 636,147

[22] Filed: Dec. 31, 1990

[30] Foreign Application Priority Data

Jan. 9, 1990 [JP] Japan ..... 2-002318

[51] Int. Cl.[5] ..... G03G 15/20

[52] U.S. Cl. ..... 219/216; 355/285; 355/290

[58] Field of Search ..... 355/282, 285, 289, 290, 355/295; 219/216; 346/76 PH

[56] References Cited

U.S. PATENT DOCUMENTS

| | | | |
|---|---|---|---|
| 3,924,943 | 12/1975 | Fletcher | 355/274 |
| 4,763,136 | 8/1988 | Isobe | 219/216 X |
| 4,954,845 | 9/1990 | Yano et al. | 355/290 |
| 4,998,121 | 5/1991 | Koh et al. | 346/160 |
| 5,026,276 | 6/1991 | Hirabayashi et al. | 432/59 |
| 5,027,160 | 6/1991 | Okada et al. | 355/282 |
| 5,043,763 | 8/1991 | Koh et al. | 355/206 |
| 5,051,784 | 9/1991 | Yamamoto et al. | 355/285 |
| 5,083,168 | 1/1992 | Kusaka et al. | 355/285 |

*Primary Examiner*—A. T. Grimley
*Assistant Examiner*—J. E. Barlow, Jr.
*Attorney, Agent, or Firm*—Fitzpatrick, Cella, Harper & Scinto

[57] ABSTRACT

An image fixing apparatus includes a movable film movable together and in contact with a recording material supporting a visualized image, the film having a base layer of insulating material and a surface low resistance layer contactable to the visualized image, the surface layer containing low resistance material; a heater extending in a direction crossing with a movement direction of the film, the film being in contact with the base layer of the film, the heater including a base plate, an electric resistance layer producing heat by electric power supply and extending along a longitudinal direction of the film adjacent the film and a protection layer for protecting the electric resistance layer; and an insulating material between the film and the protection layer only at lateral end portions of the film.

15 Claims, 3 Drawing Sheets

IMAGE FIXING APPARATUS HAVING A HEATER, A MOVABLE FILM AND ELECTRICAL INSULATING MEMBER DISPOSED AT LATENT END

FIELD OF THE INVENTION AND RELATED ART

The present invention relates to an image fixing apparatus for heat-fixing a visualized image on a recording material by heating with a heater through a film.

A heated roller type fixing apparatus is widely used for image fixing apparatus used with image forming apparatus such as a copying machine or an electrophotographic printer. However, the hot roller type fixing apparatus requires a long waiting period before a predetermined fixing temperature is reached or the surface of the heating roller. U.S. Ser. Nos. 206,767, 387,970, now U.S. Pat. No. 4,954,845, 409,341, now U.S. Pat. No. 5,043,763 416,539, now U.S. Pat. No. 4,998,121, 426,082, now U.S. Pat. No. 5,026,276, 435,247, 430,437, 440,380, 440,678, 444,802 and 446,449 now U.S. Pat. No. 5,027,160 which have been assigned to the assignee of this application have proposed an image fixing apparatus using a heater instantaneously heating an unfixed image through a thin film, whereby the waiting period is significantly reduced or eliminated. As for the film used in this fixing apparatus, it preferably comprises an insulating base layer of heat resistive resin and a parting layer which is preferably electrically conductive to prevent the electrostatic offset due to triboelectric charge.

In this case, at the lateral end portions of the film, the conductive parting layer and the heater are very close or in contact. The electric resistance of the heater producing heat by the electric power supply is covered with a protection layer to provide electric insulation between the conductive parting layer and the power supply source.

However, since the protection layer is very thin, it has a relatively large number of pin holes which deteriorates the electric insulation property, resulting in current leakage between the electric resistance layer and the conductive parting layer which may lead to the damage to the electric resistance layer.

If the thickness of the protection layer is increased, the thermal capacity of the heater must increases, and the waiting period for warming up also increases.

SUMMARY OF THE INVENTION

Accordingly, it is a principal object of the present invention to provide a thin film image fixing apparatus with adequate electric insulation provided between the conductive parting layer and the electric power supply source without increasing the waiting period.

It is another object of the present invention is to assure adequate electric insulation by provision of an electric material adjacent longitudinal ends of the heater.

It is further object of the present invention to provide a thin film image fixing apparatus wherein an insulating member is provided between the film and the protection layer of the heater.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 6:
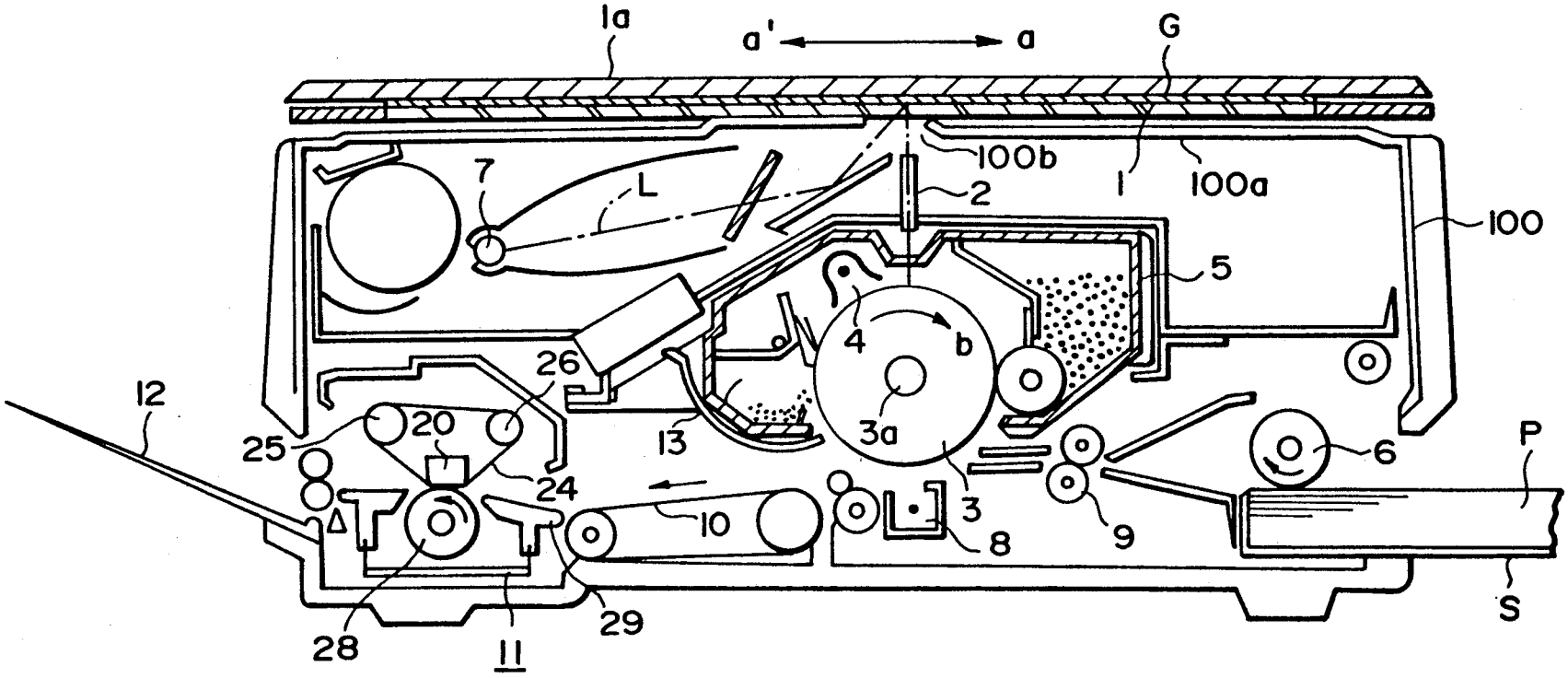
FIG. 6 is a sectional view of an image forming apparatus using the fixing apparatus of FIG. 1 embodiment.

Referring first to FIG. 6, there is shown an image forming apparatus using the image fixing apparatus according to an embodiment of the present invention. The image forming apparatus is of a movable original carriage type, rotatable drum type and image transfer type electrophotographic copying machine. The apparatus comprises a casing 100, a reciprocal original carriage made of transparent material such as glass in a top plate 100*a* of the casing 100. The original carriage 1 is reciprocally movable in directions a and a' above the top plate of the casing 100*a* at predetermined speeds. An original G is placed down on the original supporting carriage 1 at a predetermined placing reference, and is covered with an original cover 1*a*.

A slit 100*b* is formed in the top plate 100*a* of the casing and is elongated in a direction perpendicular to the reciprocal movement direction of the original carriage 1 (perpendicular to the sheet of the drawing). The bottom surface of the original G placed on the original carriage moves from the right side to the left side by the slit opening 100*b*, during which it is illuminated by a lamp 7 with light L through the slit 100*b* and the transparent original carriage 1. The light reflected by the original surface is imaged on the surface of the photosensitive drum 3 by an array 2 of short focus short diameter imaging elements. The photosensitive drum 3 is coated with a photosensitive layer such as a zinc oxide photosensitive layer or an organic photoconductor photosensitive layer. It is rotated in the clockwise direction (arrow b) at a predetermined peripheral speed about its central axis 3*a*. During the rotation, it is uniformly charged by a charger 4 to a positive or negative polarity. The uniformly charged surface of the photosensitive member is exposed to the light image of the original through the slit, so that an electrostatic latent image is sequentially formed on the surface of the photosensitive drum 3 corresponding to the imaged light.

The electrostatic latent image is visualized by developing device 5 with powdery toner made of heat softening or fusible resin. The toner image (visualized image) is conveyed to the transfer station where a transfer discharger 8 is disposed. A recording material or transfer sheet P is accommodated in a cassette S. The transfer sheets P are singled out from the cassette S by a pickup roller 6. The sheet P is fed to the transfer station at such an interrelated timing that when the leading edge of the toner image on the drum 3 reaches the position of the transfer discharger 8, the leading edge of the transfer sheet P reaches the position between the transfer discharger 8 and the photosensitive drum 3. Then, the toner image is sequentially transferred from the photosensitive drum 3 to the sheet by the transfer discharger 8. The sheet now having the toner image transferred thereto by the transfer discharger 8 is separated from the surface of the photosensitive drum 3 by an unshown separating means, and is conveyed by a conveying device 10 to an image fixing apparatus 11 where it is subjected to the heat-fixing operation so that the unfixed toner image is fixed on the sheet. Finally, the print (copy) is discharged to the outside discharge tray 12.

The surface of the photosensitive drum 3 is cleared by the cleaning device 13 after the toner image is transferred, so that the residual toner and any other contamination are removed to drum 3 for the next image formation.

The description will be made as to the fixing apparatus 11 used in this image forming apparatus.

Figure 1:
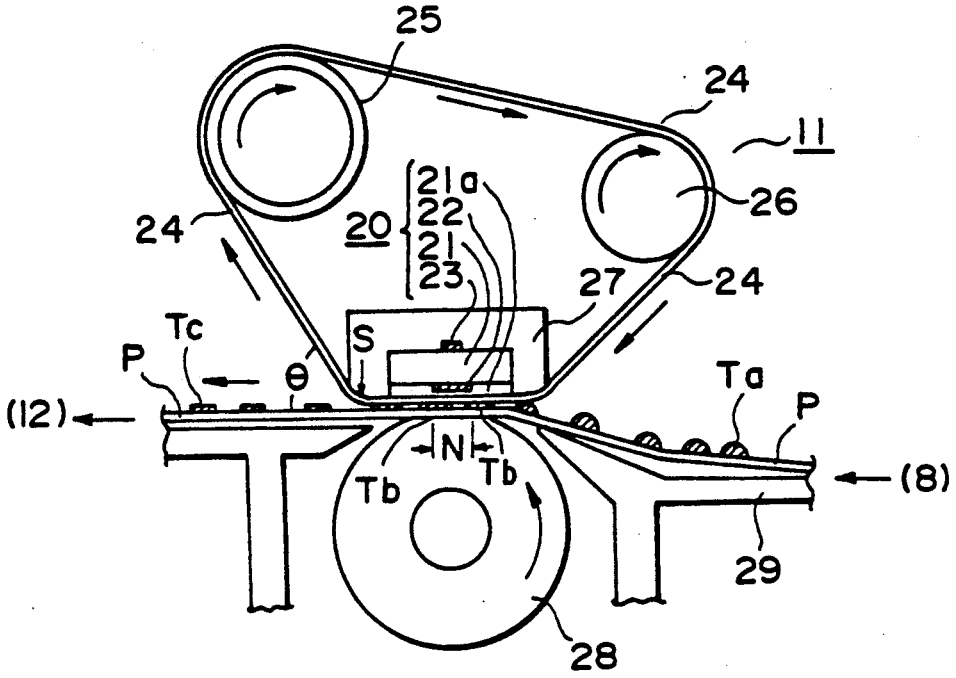
FIG. 1 is a sectional view of an image fixing apparatus according to an embodiment of the present invention.

FIG. 1 is a sectional view of the image fixing apparatus according to this embodiment. An image fixing film 24 is in the form of an endless belt and is stretched around three members, namely, a driving roller 25 (left side), a follower roller 26 (right side) and a low thermal capacity linear heater 20 disposed below a position between the rollers 25 and 26.

The follower roller 26 also functions as a tension roller for stretching the endless belt film 24. When the driving roller 25 rotates in the clockwise direction, the fixing film 24 rotates in the same direction at a predetermined peripheral speed, that is, at the same peripheral speed as the transfer sheet P carrying on its top surface the unfixed toner image Ta. The fixing film 24 is rotated without snaking movement, delay or crease.

A pressing member 28 urges the sheet P to the fixing film 24 and to the heater 20. It comprises a rubber elastic layer made of silicone rubber or the like having a good parting property.

The pressing roller 28 is urged by an unshown urging means to the heater 20 with the total pressure of 4–7 kg. It rotates along the same direction as the conveying direction of the sheet P.

Heater 20 is elongated in a direction perpendicular to the movement direction of the fixing film 24 and is in the form of a linear heater having a low thermal capacity. It comprises a heater board 21, a heat generating resistor (heat generating element) 22 instantaneously generating heat upon electric power supply thereto, and a temperature detecting element 23. It is supported on a heater supporting member 27 and is fixed to a frame of the image fixing apparatus.

The heater supporting member 27 supports the heater relative to the fixing apparatus 11 and the entire image forming apparatus and is insulating. It is made of highly heat resistive resin such as PPS (polyphenylene sulfide), PAI (polyamide imide), PI (polyimide), PEEK (polyether ether ketone) or liquid crystal polymer or a compound material comprising such a resin and ceramics or glass (heat insulating material).

The heater board 21 is a heat resistive, insulative and low thermal capacity member. For example, it may be an aluminum plate having a thickness of 1.0 mm, a width of 10 mm and a length of 240 mm.

The heat generating element 22 is applied on the bottom surface of the base plate 21 (the sliding contact side with the film 24) along substantially the center line thereof by screen printing or the like. It is made of Ag/Pd (silver palladium) or $Ta_2L$ or another electric resistance material with the thickness of approximately 10 microns and a width of 1–3 mm. The surface thereof is coated with a protection layer made of heat resistive glass **21*a*** having a thickness of approximately 10 microns.

An example of the temperature detecting element 23 is applied by screen printing on the top surface of the base plate 21 (the side opposite from the heat generating element mounted surface) substantially at the center thereof. It is a low thermal capacity temperature detecting resistor made of Pt film or the like. The temperature detecting element may be a low thermal capacity thermister contacted to the base plate 21.

The linear heater 20 of this embodiment is supplied with electric power by the electric connection at the longitudinal opposite ends by which the heat is generated substantially over the entire length of the heat generating element 22. The electric power supply in the form of an AC 100 V. In response to the detection of the temperature detecting element 23, the electric power supply is controlled by controlling a phase angle by an unshown control circuit including TRIAC.

Figure 3:
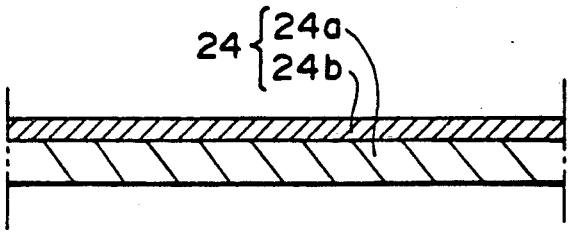
FIG. 3 is an enlarged sectional view of an image fixing film used in the embodiments of FIGS. 1 and 2.

As shown in FIG. 3, the fixing film 24 comprises an insulating base film **24*a* and a parting layer 24*b* at the recording material contactable side. The parting layer 24*b* of the fixing film, when the fixing film 24 is mounted in the apparatus, is electrically grounded by way of the rollers 25 and 26** or by other suitable known means.

With the increase of the thickness of the fixing film 24, the thermal response from the heater to the toner decreases because of the increased thermal capacity of the film, and therefore, the total thickness of the film is not more than 100 microns, preferably not more than 40 microns.

The material usable for the insulating base film **24*a*** includes a high heat resistivity resin material with good strength and heat durability such as polyimide, polyether ether ketone (PEEK), polyether sulfone (PES), polyether imide (PEI), polyparabanic acid (PPA), PFA.

The parting layer **24*b* is preferably made of fluorinated resin such as PTFE (polytetrafluoroethylene), PFA, FEP or the like, or silicone resin. The electric resistance of the surface of the fixing film 24 is lowered by adding conductive material such as carbon black, graphite, conductive whisker. By doing so, the triboelectric charge on the toner contacting side of the fixing film 24 can be prevented. If the toner contactable side of the fixing film 24 is insulating, the insulating surface is easily charged to disturb the toner image on the sheet P or to move the toner image to the film 24. By reducing the electric resistance of the fixing film 24** at the side contactable to the toner, the electric charging of the film surface can be prevented.

In order to prevent reduction of the strength of the base film 24, it is preferable not to add the conductive material.

The above problems may be avoided in this embodiment of the present invention.

Figure 4:
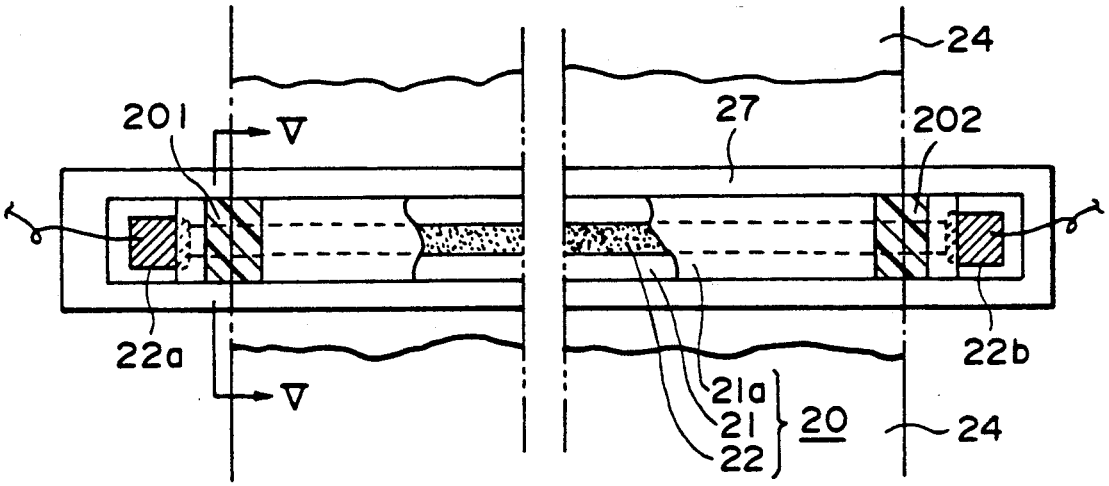
FIG. 4 is a top plan view of a film sliding side of the heater.
Figure 5:
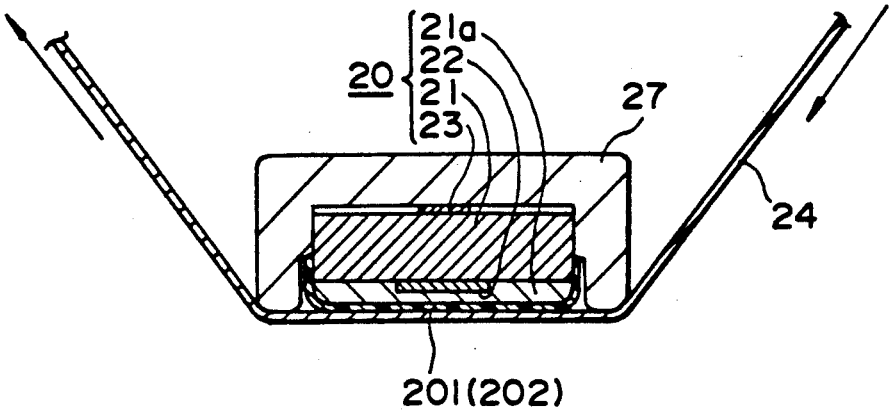
FIG. 5 is an enlarged sectional view taken along a line V—V of FIG. 4.

Adjacent opposite lateral ends of the fixing film 24, insulating materials 201 and 202 are disposed between the heater and the film (FIGS. 4 and 5). This will be described in detail hereinafter.

Figure 2:
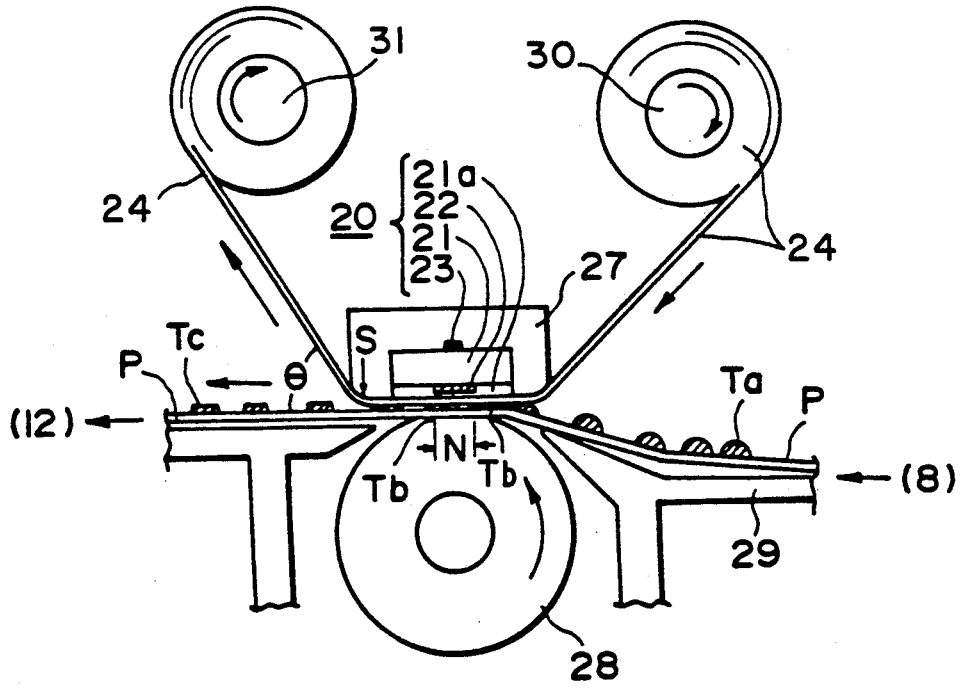
FIG. 2 is a sectional view of an image fixing apparatus according to another embodiment of the present invention.

The fixing film 24 is not limited to the endless belt form. As shown in FIG. 2, it may be in the form of a rolled film. It is supported on a supply shaft 30, and its leading end is mounted on the take-up shaft 31 through a nip between the heater 20 and the pressing roller 28. It is fed at the same speed as the conveyance of the transfer sheet from the supply shaft to the take-up shaft.

The fixing operation will be described.

Upon the production of the image formation start signal responsive to the depression of the copy switch, the image forming operation is started in the image forming apparatus, by which the transfer sheet P having the unfixed toner image Ta is fed from the transfer station 8 to the fixing apparatus 11. The transfer sheet P is guided along the guide 29 into the nip N formed between the heater 20 and the pressing roller 28 more particularly to the nip between the fixing film 24 and the pressing roller 28. The toner image bearing surface of the sheet P is conveyed in contact with the fixing film 24 at the same speed without surface deviation or crease, through the nip.

The heater 20 is supplied with the electric power at a predetermined timing after the image formation start signal, and therefore, the toner image Ta is heated, softened or fused in the nip N into a softened or fused image Tb.

The fixing film 24 during its travel deflects abruptly by the edge S of the supporting member 27 having the large curvature (radius of curvature is approximately 2 mm) (deflection angle $\theta$ is approximately 45 degrees). Therefore, the sheet P passed through the nip together with the fixing film 24 is separated from the fixing film 24 by the edge S, and is discharged to the discharge tray 12. By the time it is discharged, the toner is sufficiently cooled and solidified, and is completely fixed on the sheet P as a toner image Tc.

The toner used in this embodiment has a sufficiently high viscosity when it is heated and fused, and therefore, even if the toner temperature at the time of the separation from the fixing film 24 is higher than the toner fusing point, the adhesiveness among toner particles is far greater than the adhesive force relative to the fixing film 24. Therefore, upon the separation between the fixing film 24 and the sheet P, the toner does not offset to the fixing film 24.

In addition, at the point of separation, the temperature of the toner is higher than the glass transition point of the toner, and therefore, the resultant toner image is not too glossy, and has a high quality.

In this embodiment, the heat generating element 22 and the base plate 21 of good conductive material have small thermal capacity, and they are insulated and supported on the supporting member 27 and therefore, the surface temperature of the heater 20 at the nip N quickly reaches a sufficiently high temperature relative to the fusing point of the toner (or the fixable temperature to the sheet P), and therefore, the necessity for pre-heating the heater 20 (what is called stand-by temperature control) is eliminated, and therefore, the power consumption can be saved together with the advantage of prevention of the inside temperature rise.

The description will be made as to the insulating materials 201 and 202 at the lateral ends of the heater.

FIG. 4 is a top plan view of a film sliding side of the heater 20, and FIG. 5 is an enlarged sectional view taken along V—V of FIG. 4.

As described hereinbefore, the film 24 is moved in close contact with the glass protection layer 21*a* of the heater 20. Insulating materials 201 and 202 are interposed between the heater 20 and the film 24 adjacent lateral end portions of the film 24. In this embodiment, the lateral end portions of the heater corresponding to the lateral end portions of the film 24 are provided with a glass protection layer 21*a*.

The insulating materials 201 and 202 are of polyimide film having a thickness of 25–30 microns. They are adhered to the surface of the glass protection layer 21*a* by a heat resistive bonding agent.

As shown in FIG. 5, the insulating material 201 (202) covers the protection layer 21*a* and is extended into the inside of the heater supporting member 27. In the Figure, the insulating material 201 (202) is extended partly therein. It is also possible for the insulating member to circulate the heater 20 including the base plate 21 along the shape of the heater supporting member 27.

In FIG. 4, power supply electrodes 22*a* and 22*b* are provided at the longitudinal ends of the heat generating element 22.

By the provision of the insulating material in the form of a sheet, for example, at the portion contacting to the edges of the film 24, the electric insulation is assuredly established between the low resistance layer on the surface of the film 24 and the power source for supplying the electric power to the heat generating element 22 of the heater 20.

Since the insulating material 201 and 202 are provided only at the lateral ends, and there is no insulating material in the image fixing region, the thermal response from the heater to the toner is not influenced.

As described in the foregoing according to the present invention, the damage to the heat generating element attributable to the deteriorated electric insulation can be prevented without deteriorating the thermal response property between the heat generating element and the toner.

It is preferable that the low resistance layer 24*b* of the film 24 is directly grounded or grounded through a resistor element such as varister or the like to further assure the heat insulation.

The width and thickness of the insulating materials 201 and 202 may be determined properly by one skilled in the art in accordance with the required electric insulation degree or the like.

The insulating material preferably has a volume resistivity larger than $10^{13}$ ohm.cm.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a movable film movable together and in contact with a recording material supporting a visualized image, said film having a base layer made of electrically insulating material and a low resistance surface layer contactable to the visualized image, said surface layer containing low electric resistance material;

a heater extending in a direction crossing with a movement direction of said film, said heater being in contact with the base layer of said film, said heater including a base plate, an electric resistance layer producing heat from electric power and extending along a longitudinal direction of said film adjacent said film and a protection layer for protecting said electric resistance layer; and a thermally insulating member between said film and said protection layer only at lateral end portions of said film.

2. An apparatus according to claim 1, wherein said low resistance surface layer is of fluorinated resin to which the low resistance material is added.

3. An apparatus according to claim 1, wherein said low resistance surface layer is electrically grounded.

4. An apparatus according to claim 1, wherein said film is in the form of an endless belt, and said insulating member has a predetermined width.

5. An apparatus according to claim 1, wherein said film has a thickness not more than 100 microns.

6. An apparatus according to claim 5, wherein said film has a thickness not more than 40 microns.

7. An apparatus according to claim 1, further comprising a pressing member for pressing the recording material to said film and toward said heater.

8. An apparatus according to claim 1, wherein said insulating member is heat resistive resin material.

9. An apparatus according to claim 8, wherein the heat resistive resin material comprises polyimide resin.

10. An apparatus according to claim 1, wherein said heater includes power supply electrodes for supplying electric power to said electric resistance layer outside said insulating member in a longitudinal direction of said heater.

11. An apparatus according to claim 1, wherein said insulating member is provided at each longitudinal end portions of said film.

12. An apparatus according to claim 1, wherein said protection layer is glass.

13. An apparatus according to claim 1, wherein said insulating member is outside an image fixing area.

14. An apparatus according to claim 1, wherein said low resistance surface layer is on said base layer, and has a thickness smaller than that of said base layer.

15. An apparatus according to claim 1, wherein said base plate is good thermally conductive material, and the temperature of said heater is detected by a temperature detecting element on a side of said base plate opposite from the side having the electric resistance layer, and the electric power supplied to the electric resistance layer is controlled on the basis of an output of the temperature detecting element.

* * * * *

UNITED STATES PATENT AND TRADEMARK OFFICE

CERTIFICATE OF CORRECTION

PATENT NO. 5,196,675

DATED March 23, 1993

INVENTOR(S) Yoshihiko Suzuki, et al.

It is certified that error appears in the above-indentified patent and that said Letters Patent is hereby corrected as shown below:

COLUMN 1

Line 18, "or" should read --on--.
Line 45, "to the" should read --to--.
Line 48, "increases," should read --increase,--.
Line 58, "is" (second occurrence) should be deleted.
Line 62, "is" should read --is a--.

COLUMN 2

Line 16, "line V-V" should read --∇-∇--.

COLUMN 3

Line 17, "cleared" should read --cleaned--.

COLUMN 4

Line 23, "in" should read --is in--.
Line 44, "PFA." should read --or PFA.--.
Line 50, "conductive" should read --or conductive--.

UNITED STATES PATENT AND TRADEMARK OFFICE

CERTIFICATE OF CORRECTION

PATENT NO. 5,196,675

DATED March 23, 1993

INVENTOR(S) Yoshihiko Suzuki, et al.

It is certified that error appears in the above-indentified patent and that said Letters Patent is hereby corrected as shown below:

COLUMN 5

Line 66, "V-V" should read --∇-∇--.

COLUMN 6

Line 28, "material" should read --materials--.

Signed and Sealed this

Seventeenth Day of May, 1994

Bruce Lehman

BRUCE LEHMAN

*Commissioner of Patents and Trademarks*

*Attest:*

*Attesting Officer*